United States Patent [19]

Mizuno et al.

[11] Patent Number: 4,632,779

[45] Date of Patent: Dec. 30, 1986

[54] RADIOACTIVE WASTE PELLETS IN SOLIDIFIED FORM AND A PROCESS FOR FORMING THE SAME

[75] Inventors: Hiroko Mizuno; Makoto Kikuchi, both of Hitachi; Susumu Horiuchi, Mito; Shin Tamata, Hitachi, all of Japan

[73] Assignee: Hitachi, Ltd., Tokyo, Japan

[21] Appl. No.: 613,195

[22] Filed: May 23, 1984

[30] Foreign Application Priority Data

May 30, 1983 [JP] Japan ..... 58-95377

[51] Int. Cl.[4] ..... G21F 9/16

[52] U.S. Cl. ..... 252/629; 106/74; 250/506.1; 252/628; 252/633

[58] Field of Search ..... 252/629, 628, 633, 631; 264/0.5; 250/506.1; 106/74, 85; 206/524.1, 524.6

[56] References Cited

U.S. PATENT DOCUMENTS

| | | | |
|---|---|---|---|
| 3,213,031 | 10/1965 | Heinemann et al. | 252/633 |
| 4,058,479 | 11/1977 | White et al. | 252/633 |
| 4,115,311 | 9/1978 | Sump | 252/631 |
| 4,349,513 | 9/1982 | Ishiwata et al. | 252/631 |
| 4,482,481 | 11/1984 | Bandyopadhyay et al. | 252/628 |
| 4,505,851 | 3/1985 | Funabashi et al. | 252/628 |
| 4,518,508 | 5/1985 | Conner | 252/628 |

FOREIGN PATENT DOCUMENTS

| | | | |
|---|---|---|---|
| 0082483 | 6/1983 | European Pat. Off. | 252/633 |
| 2810593 | 9/1979 | Fed. Rep. of Germany | 252/633 |

*Primary Examiner*—Stephen J. Lechert, Jr.
*Assistant Examiner*—Howard J. Locker
*Attorney, Agent, or Firm*—Beall Law Offices

[57] ABSTRACT

The invention is concerned with radioactive waste pellets in solidified form in which radioactive waste pellets including light waste pellets having specific gravities smaller than that of a filler are solidified with the filler in a container. A cover disposed in an opening portion of the container is provided with filler injection ports which do not permit the passage of the light waste pellets. The invention is further related to a process for forming radioactive waste pellets in solidified form by injecting the filler through the filler injection ports formed in the cover, so that the radioactive waste pellets and the filler are uniformly solidified.

16 Claims, 12 Drawing Figures

RADIOACTIVE WASTE PELLETS IN SOLIDIFIED FORM AND A PROCESS FOR FORMING THE SAME

BACKGROUND OF THE INVENTION

The present invention relates to radioactive waste pellets in solidified form and a process for forming the same. Particularly, the invention relates to radioactive waste pellets in solidified form which are recommended to be formed when the radioactive waste pellets include light waste pellets having specific gravities smaller than the specific gravity of a filler, and relates to a process for forming the same.

According to a known process, a concentrated waste liquor (consisting chiefly of sodium sulfate $Na_2SO_4$) obtained by concentrating a regenerated waste liquor of used ion-exchange resin and a slurry of powdery ion-exchange resin, that are major radioactive wastes generated from boiling-water nuclear power plants, are dried, pulverized and pelletized, and the radioactive waste pellets thereof are charged into a container and are solidified with a filler.

For example, Japanese Patent Laid-Open No. 197500/1982 discloses a process according to which radioactive waste pellets are charged into a drum, and a solution of a sodium silicate composition that serves as a filler is poured into the drum, in order to seal the drum (page 5, right upper column, line 3 to left lower column, line 5 of the published specification).

The radioactive waste pellets may often include light waste pellets such as resin pellets having specific gravities smaller than the specific gravity of a filler, or may consist of light waste pellets only.

According to the above-mentioned process, when the solution of sodium silicate composition which serves as a filler is poured into a drum filled with the radioactive waste pellets, resin pellets having small specific gravities float and concentrate in the upper portion of the drum.

In this case, a layer consisting of the filler only is formed in the lower portion of the drum, and the filler is not sufficiently applied to the resin pellets that are radioactive waste pellets concentrated in the upper portion of the drum.

Therefore the filler is not uniformly applied to the radioactive waste pellets but is applied in a separated manner.

Since the filler is not uniformly applied to the radioactive waste pellets as mentioned above, the radioactive waste pellets are solidified very weakly. Further, since the radioactive waste pellets are not sufficiently charged to the lower portion of the drum, the volume of the solidified radioactive waste pellets cannot be effectively reduced.

Japanese Patent Laid-Open No. 73097/1975 discloses a container equipped with a cover which will be used for preparing radioactive waste pellets in solidified form (refer to the drawings of the published specification).

That is, it has been known to construct a container by providing a concrete cover for a concrete container which is impregnated with a polymeric monomer or a resin solution.

The above patent application, however, is concerned with the container only, but does not describe the radioactive waste pellets or the filler to be contained in the container. The above patent application does not teach to solidify radioactive wastes including light waste pellets having specific gravities smaller than that of the filler.

SUMMARY OF THE INVENTION

A first object of the present invention is to provide radioactive waste pellets in highly strongly solidified form consisting of radioactive waste pellets and a filler that are uniformly charged into a container without being separated, the radioactive waste pellets including light waste pellets having specific gravities smaller than that of the filler, or the radioactive waste pellets being composed of light waste pellets only.

A second object of the present invention is to provide a process for forming radioactive waste pellets in solidified form, being capable of uniformly charging the radioactive waste pellets and a filler into a container, and the radioactive waste pellets including at least light waste pellets having specific gravities smaller than that of the filler.

According to the present invention, a filler and radioactive waste pellets including at least light waste pellets having specific gravities smaller than that of the filler are charged into a container that is provided with a cover which has a weight greater than a buoyancy which the light waste pellets receive in the filler, the cover further having filler injection ports that do not permit the passage of light waste pellets. Therefore, there are obtained radioactive waste pellets which are highly strongly solidified since the gaps among the radioactive waste pellets are uniformly filled with the filler.

Further, the filler is injected into the container through the filler injection ports of the cover that does not permit the passage of light waste pellets, the container containing radioactive waste pellets which include at least light waste pellets having specific gravities smaller than that of the filler. Therefore, the radioactive waste pellets and the filler are not separated from each other, and the radioactive waste pellets are solidified with the filler being uniformly injected into gaps among the radioactive waste pellets. Moreover, the radioactive waste pellets do not overflow when the filler is being injected, and contamination by radioactivity can be prevented.

DETAILED DESCRIPTION OF THE PREFERRED EMBODIMENTS

Figure 1:
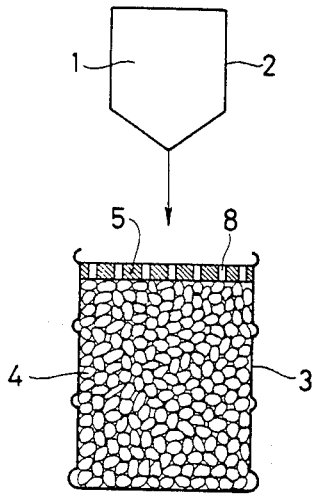
FIG. 1 is a schematic diagram for illustrating the concept of the present invention.

Embodiments of the invention will be described below. In FIG. 1, a container 3 is disposed for containing radioactive wastes under a filler tank 2 which contains a filler 1. The container 3 is filled with radioactive waste pellets 4 including at least light waste pellets that have specific gravities smaller than that of the filler 1. A cover 5 is provided in an opening at an upper portion of the container 3 to cover the radioactive waste pellets 4.

The cover 5 has a weight which is greater than the buoyancy which the light waste pellets receive in the filler 1. The cover 5 has small holes 8 which permit the passage of the filler 1 but which do not permit light waste pellets included in the radioactive waste pellets 4 to flow out. The container 3 and the cover 5 constitute a container in which the waste materials are to be solidified and are to be disposed of.

Below is described how to solidify the radioactive waste pellets. First, the container 3 is densely filled with the radioactive waste pellets 4 which include at least light waste pellets up to the upper opening portion thereof. Next, the cover 5 is placed on the radioactive waste pellets 4 near the upper opening portion of the container 3.

The filler 1 is poured onto the cover 5 from the filler tank 2. The filler 1 passes through the small holes 8 formed in the cover 5 and enters into the container 3 in sufficient amounts without permitting the radioactive waste pellets 4 to overflow. The filler 1 is poured in sufficient amounts into the container 3 up to the upper portion of the cover 5.

From the requirement that the weight of the cover must be greater than the buoyancy which the light waste pellets receive in the filler, the specific gravity of the cover is given by the following relation, $$\rho_f > \frac{l - x}{x} Pr \cdot (\rho_K - \rho_P)$$

where $\rho_f$ is the specific gravity of the cover, l denotes the height of the container, x denotes the thickness of the cover, Pr denotes charging rate of the radioactive waste pellets, $\rho_k$ denotes the specific gravity of the filler, and $\rho_p$ denotes the specific gravity of the light waste pellets.

Specifications of the cover used in the present invention will be discussed below. The following materials were used for the tests. The radioactive waste pellets included light waste pellets consisting chiefly of a mixture of sodium sulfate that is a concentrated waste liquor and used ion-exchange resin. The radioactive waste pellets had been formed in almond shapes by a granulating machine. The filler was a solution containing an alkali silicate composition, and the container was a drum having a capacity of 200 liters.

The radioactive waste pellets are prepared by mixing the sodium sulfate and the ion-exchange resin at a predetermined ratio. The major portion of the pellets consists of light waste pellets having specific gravities smaller than that of the solution of alkali silicate composition which serves as a filler. However, since sodium sulfate is partly contained at a large ratio, there are often contained pellets having specific gravities larger than that of the solution of alkali silicate composition that works as a filler.

Figure 2:
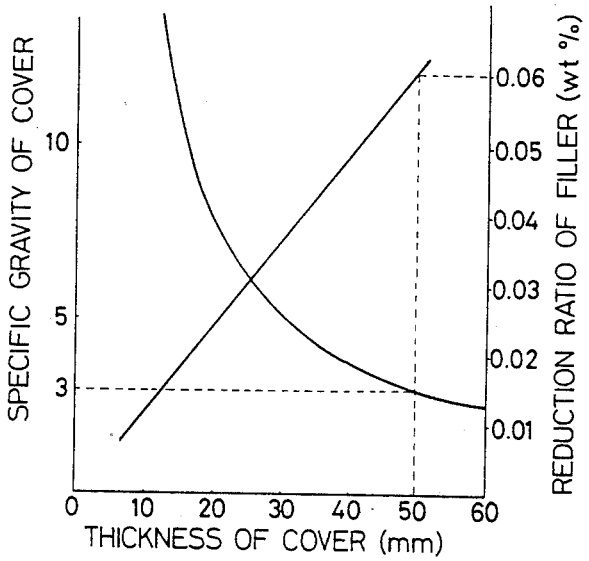
FIG. 2 is a diagram showing a relation between the specific gravity and the thickness of a cover.

FIG. 2 shows a relation between the thickness and the specific gravity of the cover. A reduction ratio of the charging amount of the radioactive waste pellets shown in FIG. 2 is given by the following relation.

$$\text{Reduction ratio of charging amount} = \frac{\text{Volume of the cover}}{\text{Volume of the container}}$$

To restrain the reduction ratio of charging amount within 0.06% by weight, the thickness of the cover must be smaller than 50 mm, and the specific gravity of the cover must be greater than 3.0. From the standpoint of crushing strength of the radioactive waste pellets, on the other hand, the radioactive waste pellets will not be crushed if the weight of the cover is smaller than about 3 tons.

To inject the filler after the cover has been fitted, the small holes in the cover must permit the passage of the filler. In this case, the filler should not be hardened while it is being injected. Further, the light waste pellets should not overflow.

Whether the filler can pass through the small holes in the cover is affected by its viscosity which also changes depending upon the temperature, time for solidification and lapse of filling time.

Figure 3:
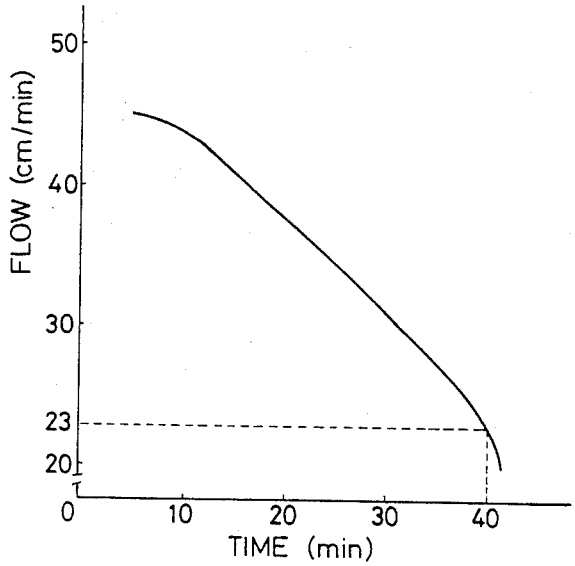
FIG. 3 is a diagram showing flow values of an alkali silicate composition and the lapse of time.

FIG. 3 shows a relation between flow values (length (cm) which the filler (solution of alkali silicate composition) travels in one minute when it is poured on a glass plate tilted by 45°) and the lapse of time.

After about 40 minutes from the injection of the filler, the paste-like filler starts to harden. Namely, the flow value decreases remarkably, and the filler cannot be injected into the gaps of the radioactive waste pellets any more. The flow value should desirably be greater than about 23 cm/min.

Figure 4:
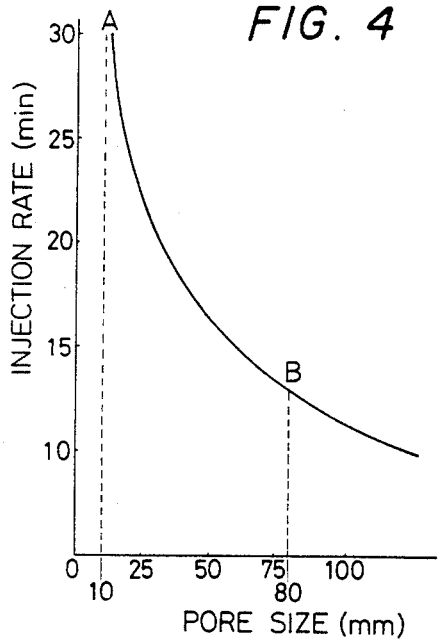
FIG. 4 is a diagram showing a relation between the size of holes formed in the cover and the time required for injecting the filler.

FIG. 4 shows a relation between the size of small holes formed in the cover and the injection time (time until the injection of the filler (solution of alkali silicate composition) into the drum of radioactive waste pellets is completed).

In this case, the small holes possessed the shape of a true circle or close to a true circle, a square shape or close to a square shape in cross section, the distance being equal or nearly equal from the periphery of the hole to the center thereof.

When the size of the holes is too small, extended periods of time are required for injecting the filler. Namely, when the holes have a small size as indicated by A in FIG. 4, extended periods of time are required for the filler to fall into the container; i.e., the filler is cured while it is falling and can no longer be injected. Therefore, a minimum size of the holes of the cover is about 10 $mm^2$ as indicated by A.

The larger the size of the holes, the greater the effect for injecting the filler. The holes, however, should have a size that does not permit the radioactive waste pellets to flow out even at the greatest. That is, the holes should have a size smaller than a minimum diameter (about 10 mm) of the radioactive waste pellets), i.e., should be smaller than about 80 $mm^2$ as indicated by a point B in FIG. 4.

From the above consideration and experiments, the sectional area of each hole (having an equal or nearly equal distance from the periphery of the hole to the center thereof) in the cover should lie from about 10 $mm^2$ to about 80 $mm^2$.

An optimum sectional area of the hole refers to a maximum sectional area that lies within the above-mentioned range and that is effective for injecting the filler or, in other words, that is effective for completing the injection before the curing proceeds.

When the container is made of concrete or of a composite material consisting of concrete and other material, the cover having small holes should also be made of the same material as the container or should be made of a mixture containing the same material, so that the container and the cover are adhered together with an increased strength and that the container is obtained in a unitary structure.

Working examples of the present invention will be described below concretely.

EXAMPLE 1

Figure 5:
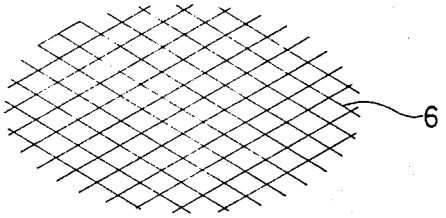
FIGS. 5 and 6 are schematic diagrams showing a method of producing the cover according to an embodiment of the present invention.
Figure 6:
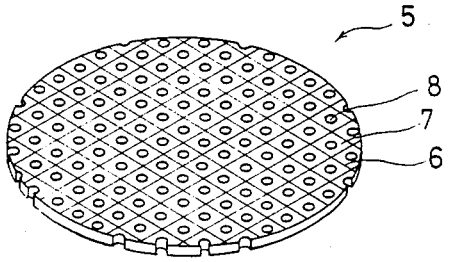

First, a gauze 6 consisting of wires, each wire being 5 mm in diameter, is prepared as shown in FIG. 5, and concrete is blown onto the wire gauze 6 to produce a cover 5 having many small holes 8, each being about 10 mm in diameter (having a sectional area of 78.5 $mm^2$), that are uniformly distributed.

Figure 7:
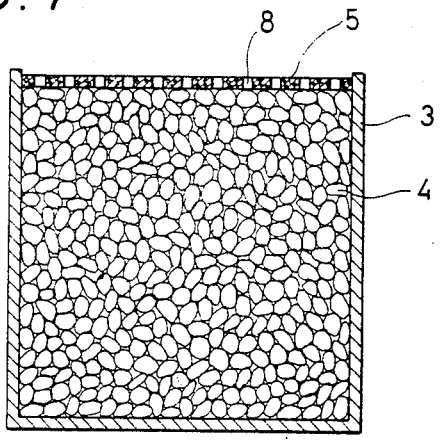
FIG. 7 is a schematic diagram illustrating a first example.

The radioactive waste pellets and the filler are charged and solidified as described below. First, about 160 kg of the radioactive waste pellets including light waste pellets which chiefly consist of sodium sulfate and used ion-exchange resin, are densely charged into the 200-liter container 3 made of a concrete, as shown in FIG. 7. The cover 5 obtained as described above is placed thereon. The filler 1 consisting of an alkali silicate composition is allowed to flow in an amount of 158 kg onto the cover 5. The filler 1 flows through the small holes 8 of the cover 5, and is uniformly injected in sufficient amounts into gaps among the radioactive waste pellets 4 from the lower portion to the upper portion of the container 3.

The product solidified according to this example was cut to observe the interior thereof. It was confirmed that the radioactive waste pellets 4 and the filler 1 had been solidified unitarily maintaining a sufficiently large strength.

Further, the radioactive waste pellets in solidified form exhibited excellent durability since the container 3 and the cover 5 had been made of a concrete, the alkali silicate composition that was a filler 1 exhibited good adhesiveness to the cover 5 made of a concrete, and further since the container 3, the cover 5 and the filler 1 were composed of inorganic materials.

EXAMPLE 2

This example is the same as example 1 with the exception that a steel drum is used instead of the container made of a concrete. The same effects are obtained as in example 1. However, the adhesiveness between the container and the concrete cover, and durability of the container, are slightly inferior to those of example 1.

EXAMPLE 3

Figure 8:
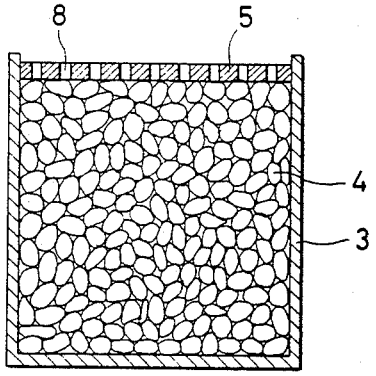
FIG. 8 is a schematic diagram illustrating a third example.

This example is the same as example 1 with the exception of using, as the cover 5, a porous plate composed of lead having a thickness of 15 mm and many small holes 8 of a diameter of 10 mm as shown in FIG. 8. The same effects are obtained as those of example 1.

The defect of this example may be an increased manufacturing cost. However, lead has a large specific gravity, and the cover 5 has a thickness smaller than that of the concrete cover which contains wire gauze. This helps increase the charging capacity of the radioactive waste pellets.

EXAMPLE 4

Figure 9:
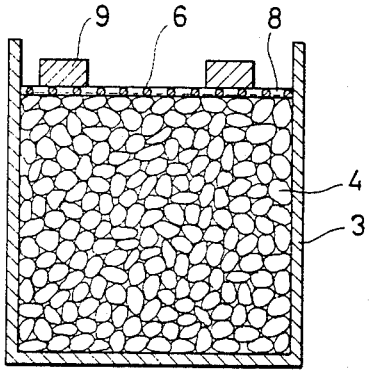
FIG. 9 is a schematic diagram illustrating a fourth example.

According to this example as shown in FIG. 9, a wire gauze 6 is used as a portion of the cover, and steel masses 9 are placed as weights thereon. The filler is poured up to the upper portion of the weights 9. The same effects as those of example 1 are obtained. In this case, the mesh of the wire gauze corresponds to ports for injecting the filler.

EXAMPLE 5

Figure 10:
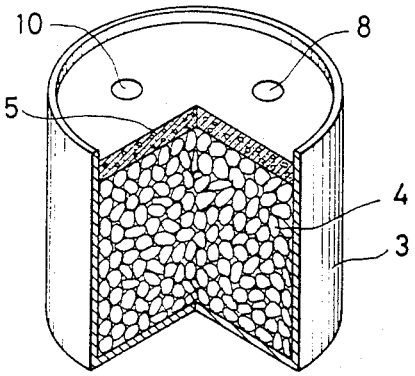
FIG. 10 is a schematic diagram illustrating a fifth example.

In example 1, many small holes 8 were uniformly distributed in the cover. In example 5, however, use is made of the cover having two holes; i.e., a small hole 8 for injecting the filler and a hole 10 for discharging the air as shown in FIG. 10. This also makes it possible to obtain the same effects as those of example 1.

Figure 11:
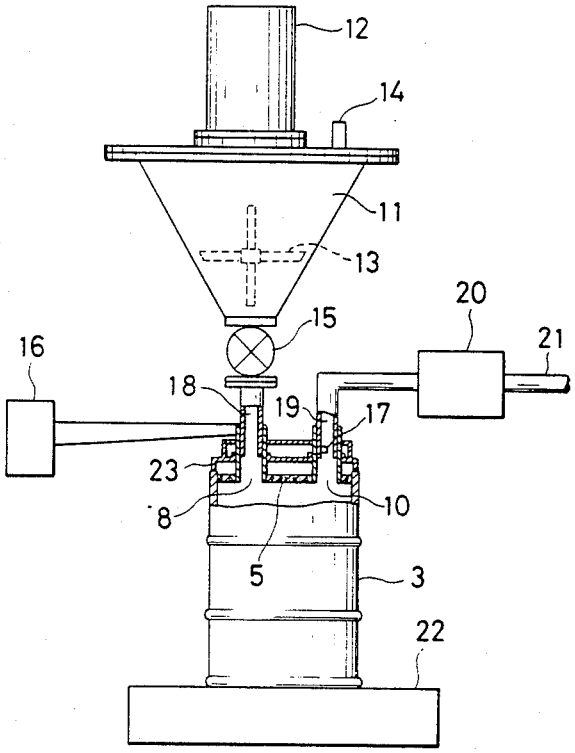
FIG. 11 is a diagram showing a charging system employed in the fifth example.

FIG. 11 shows a system for charging the radioactive waste pellets, that is adapted to example 5.

A stirrer 12 is installed above a kneading vessel 11 for kneading the filler. The kneading vessel 11 contains stirrer vanes 13 and further has a port 14 for introducing the water.

A rotary valve 15 is installed under the kneading vessel 11, and a slide rack 16 is provided by the kneading vessel 11. The cover 5 is placed on the drum 3. An air vent pipe 19 equipped with an ultrasonic water gauge 17 is attached to an air vent 10.

A hole 8 for injecting the filler is equipped with a filler injection pipe 18 that is connected to the rotary valve 15. A PEPA-filter 20 is provided at one end of the air vent pipe 19, and a ventilation duct 21 is connected to the PEPA-filter 20. The drum 3 is secured on a rack 22, and a temporarily working cover 23 is provided on the upper side to inject the filler.

The drum 3 containing the radioactive waste pellets which include at least light waste pellets is placed on the rack 22 which has a stopper to secure the drum, and the slide-type cover for injection is set to the drum. The filler and water are poured into the kneading vessel 11, and are kneaded by the kneader 12. Simultaneously with the completion of the kneading, the rotary valve 15 is operated to inject the filler from the injection pipe 18 into the drum 3. The air is discharged through the air vent pipe 19, the concentration of radioactivity is decreased through the PEPA-filter 20, and the air is ventilated through the ventilation duct 21. The filler which is injected in sufficient amounts is then detected by the water gauge 17, and the rotary valve 15 is closed.

According to the above-mentioned system which employs the rotary valve to inject the filler, the time required for injecting the filler can be reduced.

EXAMPLE 6

Figure 12:
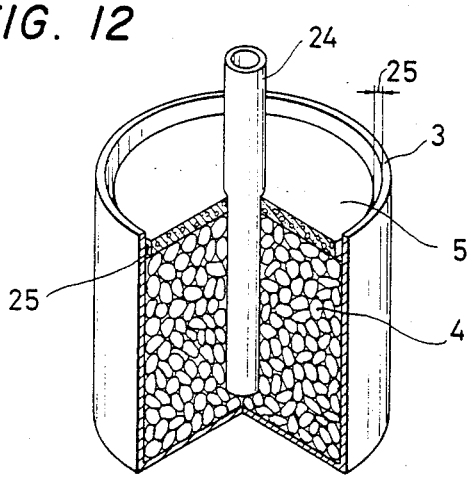
FIG. 12 is a schematic diagram illustrating a sixth example.

In this example 6, the cover 5 has a hole at the center thereof, and a filler injection pipe 24 having a diameter of about 10 mm is inserted in the hole to inject the filler as shown FIG. 12. A clearance 25 of a width of about 10 mm is maintained between the cover and the container 3. The clearance 25 is selected to such a size that the radioactive waste pellets 4 will not flow out.

According to this example, the injection of filler starts from the lower portion of the container 3 through the lower portion of the injection pipe 24 penetrating through the hole of the cover 5. Therefore, the filler can be injected even when it has a slightly large viscosity.

EXAMPLE 7

Described below is another example for preparing the cover having a filler injection port. First, silica or a material having excellent resistance against alkali and having a spherical shape or nearly a spherical shape, is arranged in a cylindrical frame to a predetermined thickness. Then, the silica or the like material is adhered together with a cement and a binder such as a solution of sodium silicate, to prepare the cover of the shape of a disc.

In the thus prepared cover are automatically formed paths, i.e., filler injection ports through which the filler will infiltrate into gaps among silica stones. This method of preparing the cover is highly practicable since the filler injection ports can be easily formed.

In this case, the filler flows down to the lower portion of the cover from the upper portion of the cover passing through amorphous filler osmosis paths that work as filler injection ports, and then fall onto the container so as to be charged therein.

Described below are the radioactive light waste pellets that are solidified according to the present invention. In this example, pellets of a mixture consisting of sodium sulfate and used ion-exchange resin are treated as the radioactive waste.

Other examples of the radioactive waste may include resin pellets obtained by drying and granulating slurry wastes such as ion-exchange resin and the like, sludge pellets obtained by drying and granulating slurry waste of sludge, as well as various solid materials such as PEPA-filter, cloths made of vinyl sheets, wood pieces, and the like, or pulverized products thereof.

Mixture pellets may also be treated such as those obtained by drying and granulating at least one of resin pellets, sludge pellets or various solid pellets, or pellets of pulverized products thereof, and a concentrated waste liquor such as sodium sulfate, sodium borate, and the like.

Or, the mixture pellets may further be composed of a mixture of resins and concentrated waste liquors such as sodium sulfate, sodium borate and the like.

The shape of the radioactive light waste pellets need not be limited to the almond shape but may be cylindrical shapes, granular shapes, or may be in a pulverized form.

In addition to the solution of alkali silicate composition, the filler may be flowable thermosetting plastic material, a plastic material which melts upon heating, asphalt, mortar, cement, or the like.

When the filler is selected from the above-mentioned examples, the light waste pellets having specific gravities smaller than that of the filler and included in the radioactive waste pellets should, for instance, be resin pellets, sludge pellets, various solid pellets, or mixture pellets consisting of a mixture of resin and concentrated waste liquor.

Further, when the cover is made of a concrete or lead, the filler injection port may be formed as numerous small holes, a single small hole, or as a clearance between the outer periphery of the cover and the container. When the wire gauze with weights is used as the cover, mesh of the wire gauze or the clearance between the outer periphery of the wire gauze and the container serves as the filler injection ports.

When the cover is prepared by using, for instance, spherical silica stones and a binder, amorphous paths formed among the silica stones will serve as filler injection ports. In this case, the filler permeates through amorphous paths to enter into the container.

What is claimed is:

1. Radioactive waste pellets in solidified form, comprising:

a container having a top opening portion;

radioactive waste pellets filling said container to closely adjacent said top opening;

a cover disposed in said top opening of said container to generally cover said waste pellets and being freely movable within said container to rest upon said waste pellets;

a solidified liquid filler comprising sodium silicate completely filling the remainder of said container and solidifying said radioactive waste pellets;

said pellets including at least light waste pellets having specific gravities smaller than the specific gravity of said filler when it is liquid;

said cover having a weight greater than the bouyancy of said light waste pellets within said filler when said filler is liquid;

said cover having filler injection port means of a shape and size to prevent the outward passage of any of said waste pellets prior to being solidified within said filler; and said injection port means being of a size and shape sufficient to pass said filler liquid therethrough to substantially completely fill the interstices between said pellets when said filler is liquid, whereby the pellets may be placed within said container, said cover may be placed upon said pellets and said liquid filler poured through said ejection port means to completely fill the remainder of the container prior to solidifying and without said light pellets lifting up said cover or passing through said ejection port means, so that said filler solidifies the pellets within said container, closes said ejection port means and securely attaches said cover to said container and pellets.

2. Radioactive waste pellets in solidified form, according to claim 1, wherein said radioactive waste pellets include resin or sludge, and said filler containing a solution of sodium silicate.

3. Radioactive waste pellets in solidified form, according to claim 2, wherein said light waste pellets are selected from the group consisting of resin pellets, sludge pellets, pellets of a concentrated waste liquor, and pellets consisting of a mixture thereof.

4. Radioactive waste pellets in solidified form, according to claim 2, wherein said filler ejection port means is a plurality of small bores having substantially an equal distance from the periphery to the center thereof, and sectional areas of from about 10 $mm^2$ squared to about 80 $mm^2$.

5. Radioactive waste pellets in solidified form, according to claim 2, wherein said cover is made of silica stones and a binder, and said filler injection port means of said cover is formed by interstices between said stones forming osmosis paths for said filler when said filler is liquid.

6. Radioactive waste pellets in solidified form, according to claim 1, wherein said container is about 200 liters in volume, the ratio of the volume of said cover to the volume of said container being about 0.06%, the thickness of said cover being less than 50 mm, and the specific gravity of said cover being greater than 3.0.

7. Radioactive waste pellets in solidified form, according to claim 6, wherein said cover weighs less than 3 tons.

8. A process for forming radioactive waste pellets in solidified form, comprising:

filling a container having a top opening with radioactive waste pellets;

placing a cover within said top opening of said container and freely moving said cover downwardly to rest upon said radioactive waste pellets and generally cover the same;

providing a liquid filler comprising a solution of sodium silicate having a specific gravity greater than the specific gravity of at least some of said waste pellets;

pouring said liquid filler onto said cover when it is resting upon said radioactive waste pellets, past said cover when it is resting upon said radioactive waste pellets, and in to the interstices between said radioactive waste pellets to completely fill the remainder of said container while said cover is resting upon said radioactive pellets;

maintaining the rest position of said cover during said step of filling by providing said cover with a weight greater than the bouyancy of said waste pellets within said liquid filler;

securely retaining said radioactive waste pellets in said container during said step of filling by providing injection port means as a part of at least said cover of a size sufficiently large to pass said liquid filler therethrough to substantially completely fill said container and of a shape and size sufficient to prevent outward passage of said radioactive waste pellets; and thereafter uniformly solidifying said liquid filler with said radioactive waste pellets therein and thereby rigidly secure said cover to said container and said radioactive waste pellets, and seal said injection port means.

9. The process according to claim 8, wherein said step of filling only passes the liquid filler through small osmosis paths formed in said cover.

10. The process according to claim 8, including the preliminary step of forming said radioactive waste pellets from one or more materials selected from the group consisting of resin, sludge and concentrated waste liquor.

11. The process of claim 8, including the preliminary step of forming said cover by spraying a cement material onto a wire grid so that said wire is covered by the cement and injection ports remain in the gridwork between the wires, and thereafter solidify the cement.

12. The process of claim 8, including the preliminary step of forming said cover from a wire gridwork and providing separate weights holding said wire gridwork onto the top of said radioactive waste pellets.

13. The process of claim 8, including the preliminary step of forming said cover with a tube extending therethrough, generally through said radioactive pellets to adjacent the bottom of said container, and said step of filling pours the liquid filler through said tube.

14. The process of claim 8, wherein said step of filling passes the liquid filler through a single injection port in said cover while exhausting air from said container from a peripheral gap between said cover and said container.

15. The process of claim 8, wherein said step filling passes the liquid filler through a single injection port in said cover while exhausting air from said container through a separate exhaust port through said cover.

16. The process of claim 8, wherein said step of filling provides a flow rate of said liquid filler through said cover injection port means that is greater than 23 cm per minute.

* * * * *